United States Patent [19]

Acton

[11] 4,044,435

[45] Aug. 30, 1977

[54] CASKET WITH SUPPORTED PALLET

[75] Inventor: Hugh Acton, Augusta, Mich.

[73] Assignee: Boyertown Burial Casket Company, Boyertown, Pa.

[21] Appl. No.: 618,147

[22] Filed: Sept. 30, 1975

[51] Int. Cl.[2] ..... A61G 17/00

[52] U.S. Cl. ..... 27/2

[58] Field of Search ..... 27/2, 3, 7, 12

[56] References Cited

U.S. PATENT DOCUMENTS

| | | | |
|---|---|---|---|
| 1,204,672 | 11/1916 | Leigh et al. | 27/2 |
| 1,261,707 | 4/1918 | Cook | 27/2 |
| 1,800,793 | 4/1931 | Harms | 27/2 |
| 1,934,425 | 11/1933 | Harms | 27/2 |
| 2,142,553 | 1/1939 | Benoit | 27/12 |
| 3,164,880 | 1/1965 | Hotchkiss | 27/3 |

*Primary Examiner*—John D. Yasko

*Attorney, Agent, or Firm*—Paul & Paul

[57] ABSTRACT

A casket of the tub and lid type is provided, with the tub having supports on inner walls that are of the channel type, for engaging rod lengths at the periphery of a pallet, and for carrying thereby a pallet of the flexible sheet type.

4 Claims, 3 Drawing Figures

CASKET WITH SUPPORTED PALLET

BACKGROUND OF THE INVENTION

While caskets have been developed in many forms in the past, some of which have been of the type comprising a tub and a lid, and even of the type wherein either or both of the tub or lid comprise spaced shell portions with a foam or other rigidifying filler therebetween, such development in this art area has not been addressed to caskets having supported pallets therein, especially when the pallets are of the flexible type and are supported by integrally formed portions of the casket walls.

THE PRESENT INVENTION

The present invention is directed to providing a casket having interior supports for supporting a pallet therein, and especially for supporting a flexible pallet by supports that are carried by, and integral with inner wall portions of the tub of the casket.

Accordingly, it is a primary object to provide a novel casket.

It is a further object of this invention to provide a novel casket and pallet combination.

It is a further object of this invention to provide a novel casket having integral interior wall-associated supports for supporting a pallet therein.

It is another object of this invention to provide a casket, tub and lid portions of which are comprised of spaced shelves with a rigidifying filler therebetween, and wherein pallet support means are provided as part of the interior of the tub.

Other objects and advantages of the present invention will be readily apparent to those skilled in the art by reading of the following brief descriptions of the drawing figures, detailed description of the preferred embodiment, and the appended claims.

BRIEF DESCRIPTION OF THE DRAWING FIGURES

BRIEF DESCRIPTION OF THE PREFERRED EMBODIMENTS

Figure 1:
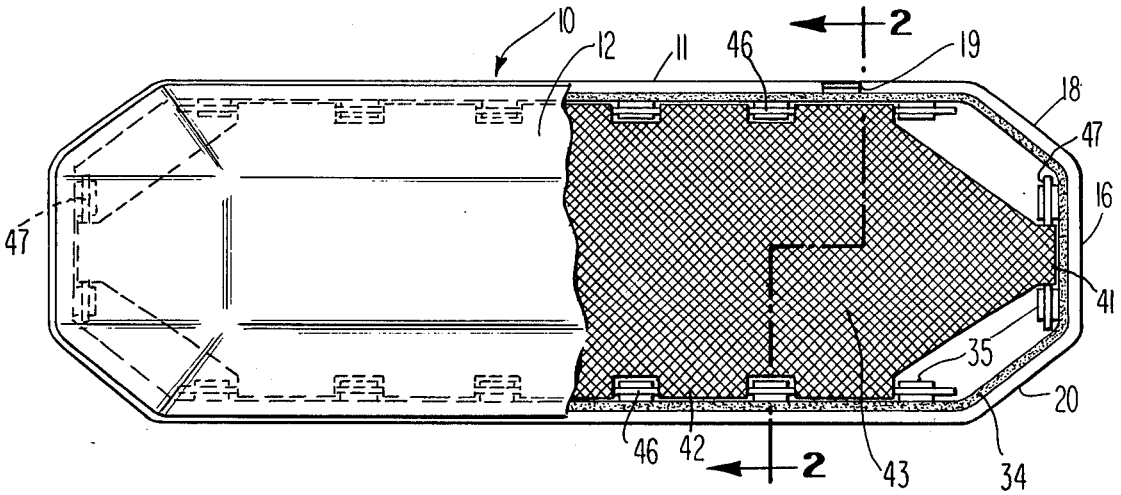
FIG. 1 is a top plan view of a casket, with a portion of the casket lid broken away to illustrate interior components.

Referring now to the drawings in detail, reference is first made to FIG. 1, wherein the casket is generally designated by the numeral 10, as comprising a tub 11 with a lid 12 disposed thereover. A pallet 13 is disposed inside the casket 10, carried by the tub 11.

The tub portion 11 has side walls 14 and 15, and end walls 16 and 17. In the particular embodiment illustrated, the end walls 16 and 17 are provided with corner portions 18 and 20 connecting side walls and end walls. In this respect, the corner portions 18 and 20 are considered to be portions of the end walls.

The side walls and end walls are connected by a bottom wall portion 21.

The tub is basically comprised of an inner shell 22, and outer shell 23, and a filler material, such as polyurethane foam or the like 24 that may be molded, blown or otherwise placed between the shells 22 and 23, for rigidity and support. The shells 22 and 23 are joined together at the upper end 25 of the wall portions 14 through 20. This joining may be by any suitable means, such as heat sealing or the like.

The lid 12 is likewise comprised of an outer shell 26 and an inner shell 27, filled with a similar preferably foam type filler material of the plastic type 28, with the lower portion 30 of the lid 12, where the shells 26 and 27 come together, being suitably sealed to contain the filler 28 therein. The lid is provided with an inner depending lip portion 31 extending thereabout, to define with an upstanding portion 32 of the tub 11 a recess for reception of a pair of flat rubber seals 33 and 34 therein (preferably one of the seals 33 and 34 being carried by each of the lid and tub), for sealing the interior of the casket 10 from the outside environment.

Figure 2:
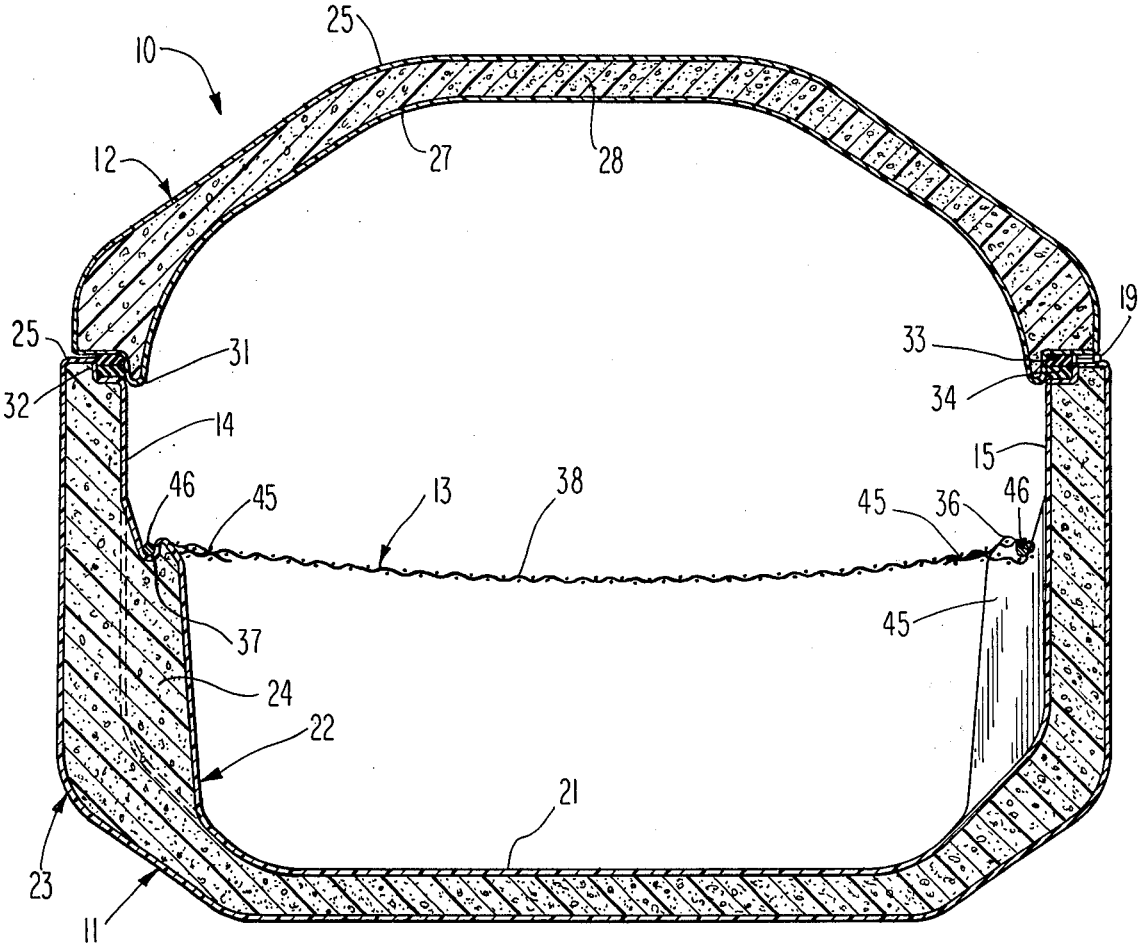
FIG. 2 is an enlarged transverse sectional view taken through the casket of FIG. 1, generally long the line 2—2 of FIG. 1, and wherein the pallet support integral with the casket is illustrated.
Figure 3:
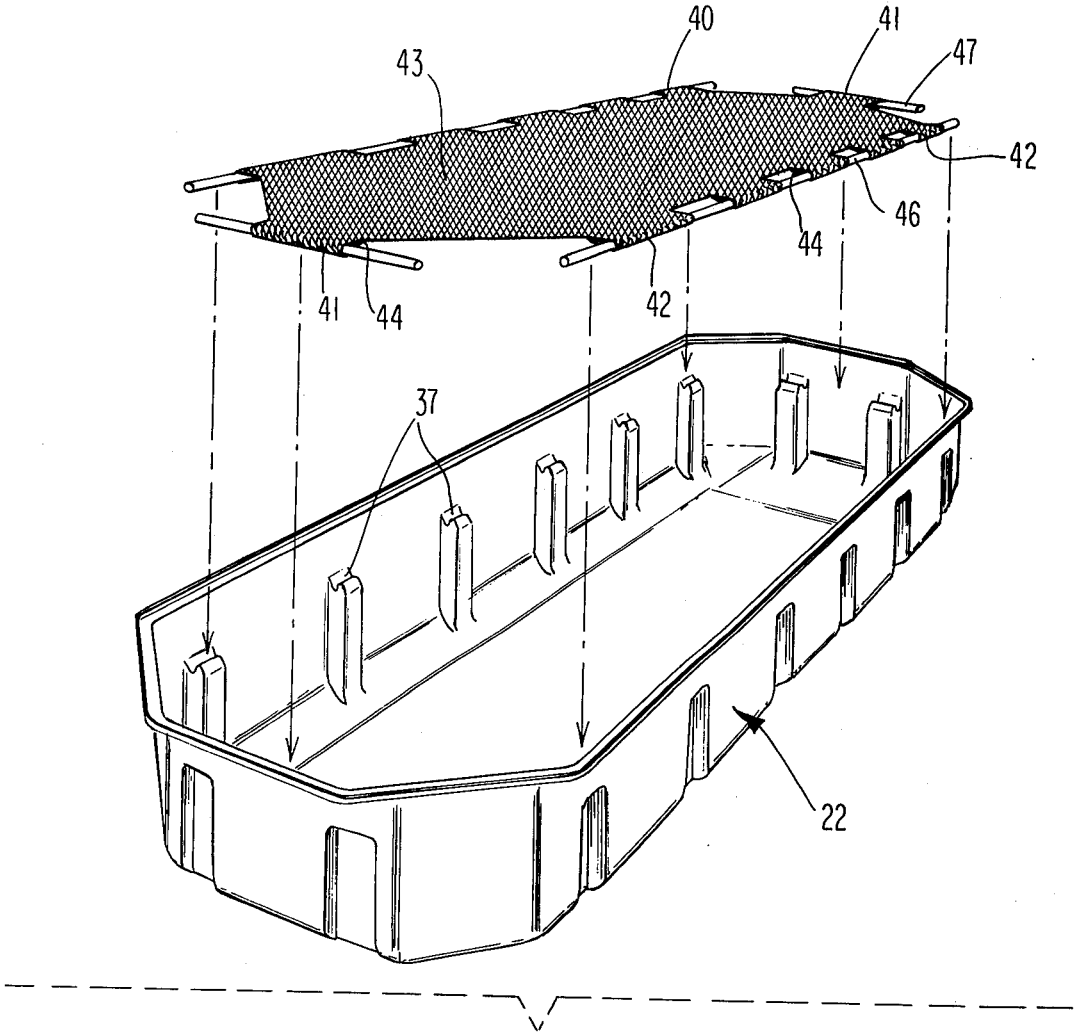
FIG. 3 is an exploded perspective view of the pallet and casket shell in accordance with this invention.

The tub 12 is provided with a plurality of pallet support means 35, each being substantially identical in construction, and extending about the interior of the shell 22, at a location below the upper portion 25 of the tub wall but above the bottom 21 of the tub, and generally at about the relative elevation illustrated in FIG. 2. These engagement portions 35 are preferably integrally molded with the shell 22, and terminate in upward protrusion portions 36 that define upwardly opening channels as is best illustrated in FIG. 3.

The pallet 13 is comprised of a mesh or other preferably flexible planar portion 38 constructed for generally horizontal disposition as is best illustrated in the drawing figures, to be provided with engagement portions 40, 41, 42, etc. extending substantially entirely about its periphery, around the sides and at the ends thereof, such engagement portions 40 through 42 extending outwardly of the supporting surface portion 43 thereof, and comprising tunnels 44 in the preferably fabric construction of the pallet supporting surface portion 43, by suitable stitching, heat sealing, etc. construction 45, for receipt of rod sections of engagement means, adapted to be received within the upwardly opening channel portions 37 that support the rods 46, 47, therein. It will be noted that preferably one long rod 46 will be provided for engagement in supporting channel means 37 and shorter end rods 47 will be provided for engagement within associated upwardly opening channels 37 along casket end walls. Thus, the support for the pallet 13 will appear as indicated in FIGS. 1 and 2.

It will be apparent that the supporting surface of the pallet may be of any suitable construction, and may even be of substantially rigid or rigid construction, if desired, although flexible sheet-like material may be preferable. Also, the tunnel portions at the edges of the sheet 43 could be narrower in width, even approaching the thickness of belt loops, if desired, but will most preferably be of substantially a width as allowed by the spacing between the pallet support means 35.

It will further be apparent that the various shells can be of metal, plastic or other materials of construction that lend themselves to moldability, heat forming, or the like, or if desired could even be constructed of wood or the like. However, in most instances a molded plastic construction will be preferred that may or may not have a wood grain or the like exterior. Also, any type of connection between the lid and tub, such as the use of hinges 19 or the like may be employed, although other variations of connection between the lid and tub may be employed, such as detachable connections or the like, as desired.

It will be apparent from the foregoing that no hardware or carrying facilities are provided for the casket of the construction illustrated herein, it being apparent that any suitable carrying facilities may be employed, and the exterior design from this standpoint, as well as from an artistic or decorative standpoint may take on any of many possible variations. It will further be apparent that many other details of construction as well as use and other features of the present invention may be modified within the spirit and context of the present invention as defined in the appended claims.

What is claimed is:

1. A casket assembly comprising a tub portion and a lid portion closable therewith; the tub portion comprising a peripheral upstanding wall portion defining sidewalls and end walls, the wall portion extending upwardly of and about a bottom wall portion, pallet support means disposed inwardly of and about the interior of said upstanding wall portion, and including a pallet for disposition in said tub, said pallet having engagement portions at its periphery for engagement with and support by said pallet support means, said pallet also including supporting surface means extending between said engagement portions and in generally horizontal planar disposition upon engagement of said engagement portions with associated said pallet support means about said wall portion wherein said supporting surface means comprises a flexible sheet-like member and wherein said engagement means comprise rod means extending about the periphery of said supporting surface means and wherein said sheet-like member includes tunnel portions at its periphery in which said rod means are disposed.

2. A casket assembly comprising a tub portion and a lid portion closable therewith; the tub portion comprising a peripheral upstanding wall portion defining sidewalls and end walls, the wall portion extending upwardly of and about a bottom wall portion, pallet support means disposed inwardly of and about the interior of said upstanding wall portion, and including a pallet for disposition in said tub, said pallet having engagement portions at its periphery for engagement with and support by said pallet support means, said pallet also including supporting surface means extending between said engagement portions and in generally horizontal planar disposition upon engagement of said engagement portions with associated said pallet support means about said wall portion wherein said pallet support means comprise upwardly opening support channel means about the interior of and spaced below an upper periphery of said wall portion, wherein said pallet support means comprise a plurality of separate spaced apart said channel means, wherein said channel means are integral with the interior of said wall portion and wherein said engagement means comprise rod means extending about the periphery of said supporting surface means, wherein said rod means comprise a plurality of separate rod lengths, wherein said supporting surface means comprises a flexible sheet-like member, wherein said sheet-like member includes tunnel portions at its periphery in which said rod lengths are disposed, with said rod lengths having exposed portions located about the periphery of said sheet-like member at substantially corresponding locations thereabout as the locations of said channel means for reception of said rod means in said channel means.

3. A casket assembly comprising a tub portion and a lid portion closable therewith; the tub portion comprising a peripheral upstanding wall portion defining sidewalls and end walls, the wall portion extending upwardly of and about a bottom wall portion, pallet support means disposed inwardly of and about the interior of said upstanding wall portion, and including a pallet for disposition in said tub, said pallet having engagement portions at its periphery for engagement with and support by said pallet support means, said pallet also including supporting surface means extending between said engagement portions and in generally horizontal planar disposition upon engagement of said engagement portions with associated said pallet support means about said wall portion, wherein said pallet support means comprise upwardly opening support channel means about the interior of and spaced below an upper periphery of said wall portion, wherein said pallet support means comprise a plurality of separate spaced apart said channel means, wherein said channel means are integral with the interior of said wall portion, wherein said engagement means comprise rod means extending about the periphery of said supporting surface means, wherein said rod means comprise a plurality of separate rod lengths, wherein said supporting surface means comprises a flexible sheet-like member, wherein said sheet-like member includes tunnel portions at its periphery in which said rod lengths are disposed, with said rod lengths having exposed portions located about the periphery of said sheet-like member at substantially corresponding locations thereabout as the locations of said channel means for reception of said rod means in said channel means and wherein said rod means and complemental channel means are disposed along both side walls and both end walls of the upstanding wall portion of said tub means.

4. A casket assembly comprising a tub portion and a lid portion closable therewith; the tub portion comprising a peripheral upstanding wall portion defining sidewalls and end walls, the wall portion extending upwardly of and about a bottom wall portion, pallet support means disposed inwardly of and about the interior of said upstanding wall portion, and including a pallet for disposition in said tub, said pallet having engagement portions at its periphery for engagement with and support by said pallet support means, said pallet also including supporting surface means extending between said engagement portions and in generally horizontal planar disposition upon engagement of said engagement portions with associated said pallet support means about said wall portion, wherein said pallet support means comprise upwardly opening support channel means about the interior of and spaced below an upper periphery of said wall portion, wherein said pallet support means comprise a plurality of separate spaced apart said channel means, wherein said channel means are integral with the interior of said wall portion, wherein said engagement means comprise rod means extending about the periphery of said supporting surface means, wherein said rod means comprise a plurality of separate rod lengths, wherein said supporting surface means comprises a flexible sheet-like member, wherein said sheet-like member includes tunnel portions at its periphery in which said rod lengths are disposed, with said rod lengths having exposed portions located about the periphery of said sheet-like member at substantially corresponding locations thereabout as the location of said channel means for reception of said rod means in said channel means, wherein said rod means and complemental channel means are disposed along both side walls and both end walls of the upstanding wall portion of said tub means and wherein each of said tub portion and said lid portion comprise an inner shell portion and an outer shell portion substantially spaced-apart with an intermediate foam-like substance filling the space therebetween, including sealing means carried at the upper end of said wall portion for sealing said tub portion and said lid portion together upon closing.

* * * * *